United States Patent [19]

Belbel et al.

[11] Patent Number: 4,700,160

[45] **Date of Patent: * Oct. 13, 1987**

[54] REMOTE CONTROL CIRCUIT BREAKER HAVING A RETRACTABLE SWITCH CONTACT

[75] Inventors: Elie Belbel, Epinay sur Seine; Christian Bataille, Ville D'Avray; Christian Blanchard, Rueil Malmaison; André Haury, Le Raincy; Michel Lauraire, Courbevoie, all of France

[73] Assignee: La Telemecanique Electrique, France

[ * ] Notice: The portion of the term of this patent subsequent to Jul. 21, 2004 has been disclaimed.

[21] Appl. No.: 820,298

[22] Filed: Jan. 21, 1986

[30] Foreign Application Priority Data

Nov. 15, 1985 [FR] France ..... 85 17208

[51] Int. Cl.[4] ..... H01H 75/00; H01H 77/00; H01H 83/00

[52] U.S. Cl. ..... 335/14; 335/6; 335/20

[58] Field of Search ..... 335/6, 14, 20, 195, 335/61

[56] References Cited

U.S. PATENT DOCUMENTS

| | | | |
|---|---|---|---|
| 3,071,664 | 1/1963 | Priesemuth | 335/61 |
| 4,473,860 | 9/1984 | Thomas | 335/6 |
| 4,553,115 | 11/1985 | Grunert et al. | 335/14 |
| 4,598,263 | 7/1986 | Heyne | 335/14 |
| 4,604,596 | 8/1986 | Yokoyama et al. | 335/16 |

*Primary Examiner*—E. A. Goldberg
*Assistant Examiner*—Lincoln Donovan
*Attorney, Agent, or Firm*—William A. Drucker

[57] ABSTRACT

A circuit breaker is provided with at least one switching arrangement having a mobile contact and a retractable contact, this latter being supported by a pivoting lever; a tripping mechanism for causing the rapid opening of the mobile contact, an electromagnetic actuator having an element movable in translation under the effect of a control signal applied to the actuator and a mechanical coupling for transmitting the movement of the mobile element to the retractable contact, wherein the mechanical coupling is rigid and moves in translation according to a translation plane parallel to the movement of the mobile element and it is coupled to said pivoting lever at a point offset with respect to the plane of translation.

3 Claims, 4 Drawing Figures

REMOTE CONTROL CIRCUIT BREAKER HAVING A RETRACTABLE SWITCH CONTACT

BACKGROUND OF THE INVENTION

1. Field of the Invention

The invention relates to a circuit breaker, in particular a multiphase circuit breaker, comprising a quick trip mechanism which may be set and tripped by means of a local manual control member, a multiplicity of power circuits each comprising a switching device whose mobile contact is connected to said mechanism so as to be closed or opened thereby, detectors which react to overcurrents of different kinds in these circuits by causing tripping of said mechanism and, consequently, automatic opening of the switch device and an electromagnet causing remote controlled opening of a retractable contact of this switch without causing tripping of this mechanism.

2. Description of the Prior Art

From patent No. 84 17505, filed on the Nov. 16 1984 in the name of the applicant for: "Circuit breaker apparatus with remote controlled opening and closure of its circuits", a circuit breaker of the above mentioned type is known in which the fixed contact of each switch means is carried by a pivoting conducting lever actuated by means of a single transmission means, through the armature of an electromagnet which has no connection with the quick trip mechanism.

The embodiments proposed in this patent for the transmission means are relatively complex.

SUMMARY OF THE INVENTION

The invention provides an arrangement of the transmission means which provides both a remote control assembly of very compact and very simple construction, satisfactory amplification of the movement of the retractable contacts with respect to the stroke of the armature and allows the tripping mechanism, the detectors and the different members comprised by a traditional circuit breaker to be used without having to modify the structure thereof.

These results are obtained in accordance with the invention because a rigid transmission means moves in translation parallel to the plane of movement of the armature, and because it is coupled to the pivoting levers in a plane offset with respect to said moving plane.

In a preferred embodiment, the transmission means comprise a rake having two legs hitched to the armature and a cross piece having grooves cooperating with coupling pieces integral with the respective pivoting levers; said cross piece is guided at both respective ends in the plane of movement of the armature and in a parallel plane in which the coupling pieces are situated; these latter are parallel to the pivoting axis of the levers and perpendicular to the movement; the grooves are adapted so as to allow relative movement of the coupling pieces perpendicular to the guide planes and the cross piece bears on said parallel plane through balls.

BRIEF DESCRIPTION OF THE DRAWINGS

Other features and advantages of the invention will be clear from the following description, with reference to the accompanying Figures in which.

DESCRIPTION OF THE PREFERRED EMBODIMENTS

Figure 1:
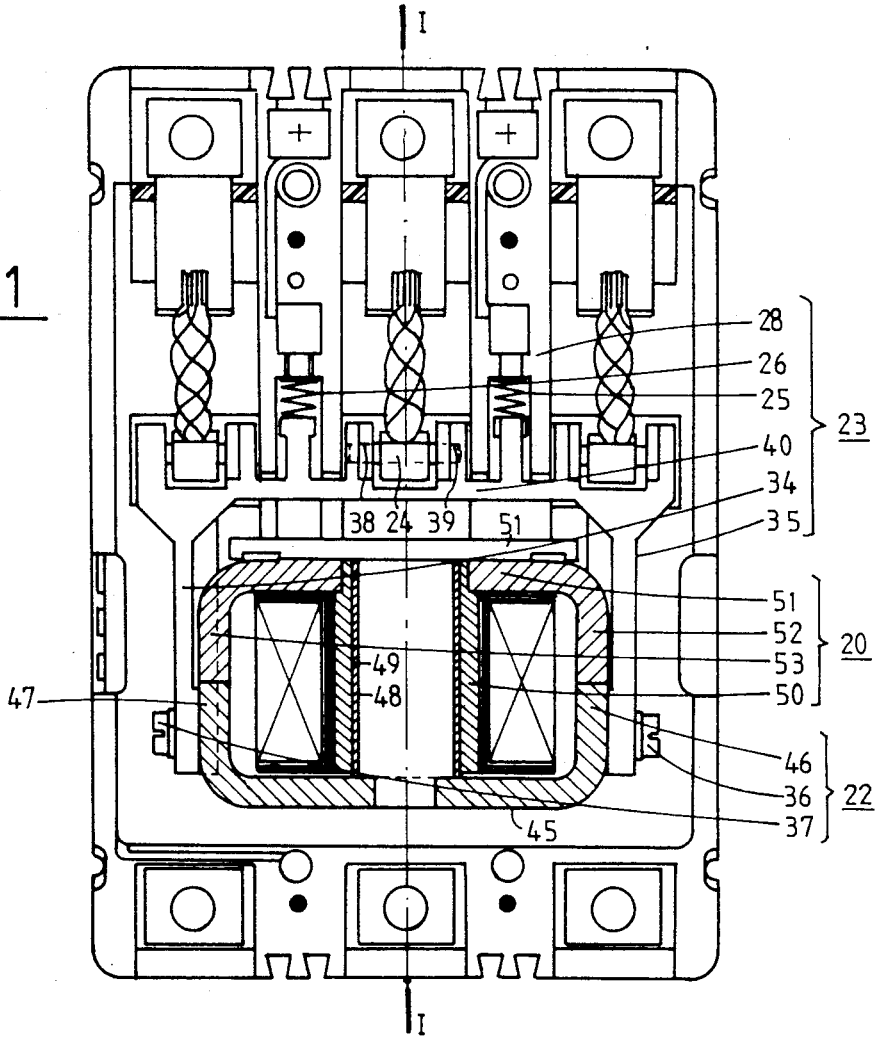
FIG. 1 shows a circuit breaker according to a preferred embodiment of the invention, in section through II—II of FIG. 2.
Figure 2:
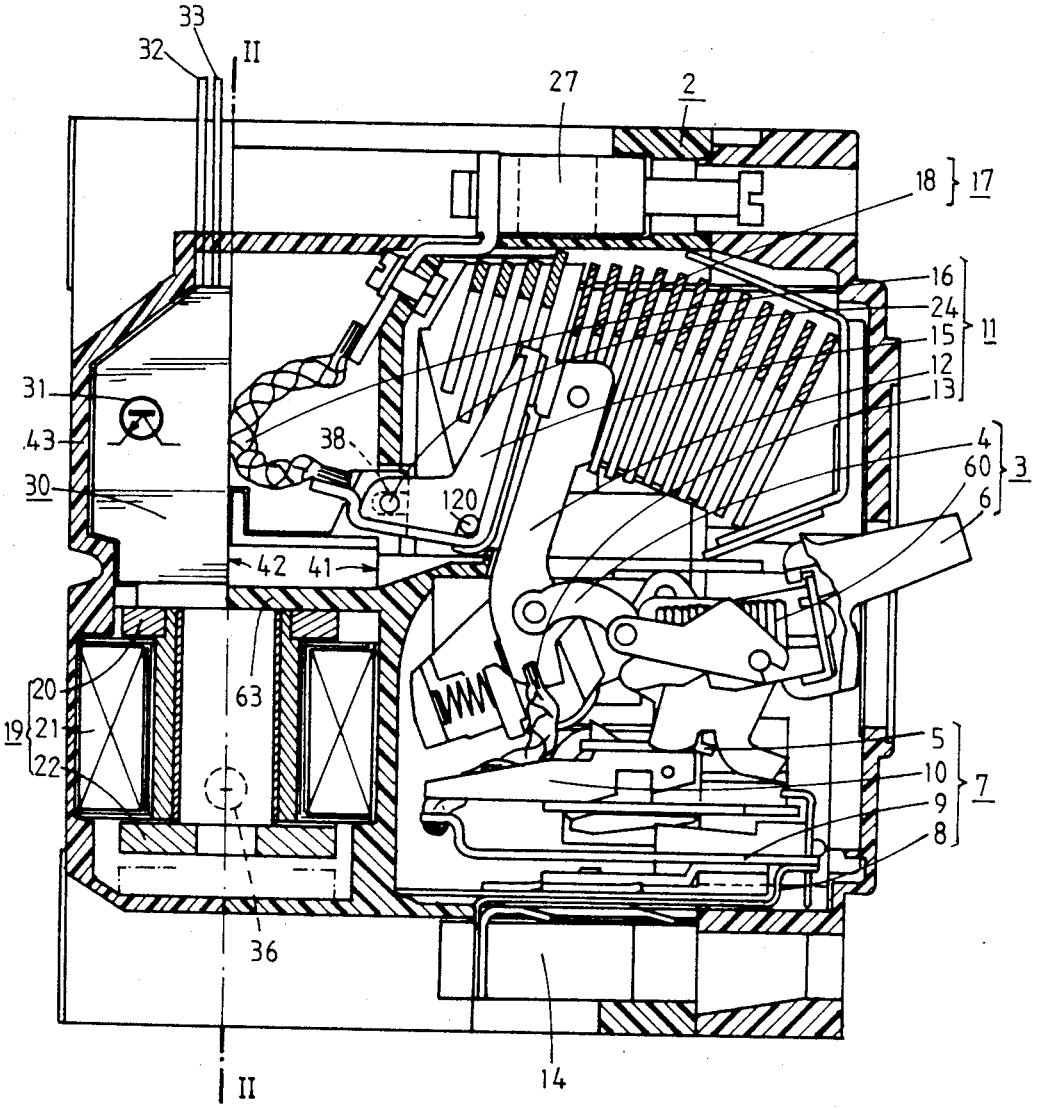
FIG. 2 is a sectional view of this circuit breaker through I—I of FIG. 1.

In FIGS. 1 and 2 a circuit breaker is shown comprising, housed in an insulating molded case 2, a force accumulating mechanism 3, current detector devices 7, switching devices 11, a single electromagnet 19 and, housed in a case 30 molded on case 2, electronic circuits (symbolized by a transistor 31) adapted for delivering to the coil 21 of electromagnet 19 high attraction currents and a more reduced holding current, in response to a control signal applied to two terminals 32–33.

The force accumulator mechanism 3, of a type known per se, comprises an actuating link 4, an accumulator spring 60, a latch 5 and a setting handle 6 for setting this mechanism or tripping it.

The current detector devices 7, equal in number to that of the phases (three in the example shown) each comprise, in a way known per se, a bimetallic strip 8 and a magnetic device 9 which are adapted to react to extended current overloads and, respectively, to high intensity currents such as those of short circuits, for moving a rocking assembly 10 on which latch 5 bears; this device 7 is connected to an output terminal 14.

The switch devices 11, equal in number to that of the phases, each comprise, in a way known per se, a mobile pivoting contact 12 connected electrically by a braided connection 13 to the corresponding monitoring device 7 and mechanically to the link 4, as well as a retractable pivoting contact 15 which is connected by a braided connection 16 to an output terminal 27.

Contact 15 is fixed during tripping of the circuit breaker and is only moved when it is desired to cause remote controlled opening of the circuit, as was explained above.

The arc chambers 17, equal in number to that of the phases are each provided, in a way known per se, with fins 18 for splitting up the arcs appearing when the switch device opens.

A multiple rake 23 connects the armature 22 of the electromagnet 19 to respective connecting members integral with the respective contacts such as 15.

These connecting members are formed by pins such as 24 integral with the respective levers 15. Each pin is engaged at its ends in two coupling grooves 38–39, perpendicular to the plane II—II.

Rake 23 comprises a cross piece 40 and two legs 34–35 (FIG. 1).

The cross piece 40 is guided in translational movement between two surfaces 41 and 42 parallel to the plane II—II. The surface 41 belongs to case 2, whereas the surface 42 belongs to the case 30.

Figure 4:
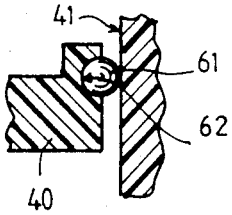
FIG. 4 shows schematically the cross piece bearing through balls on the guide plane in which the coupling pieces are contained.

The cross piece 40 bears against the surface 41 through balls such as 61 placed in housings 62 in the cross piece 40 (FIG. 4). The grooves 38–39 are formed in fork joints with which the cross piece is provided and are situated at the level of surface 41, so that pin 24 is substantially offset with respect to the plane II—II.

The mobile armature 22 comprises (FIG. 1) a cross piece 45, two legs 46–47 and a cylindrical core 48 coated with a layer of antifriction material. Core 48 slides in a cylindrical mating socket 50 fixed in a cross piece of the fixed yoke 20 which itself comprises two arms 52–53 cooperating magnetically with legs 46–47.

It can be seen in FIG. 1 that the legs 34–35 of the rake surround the mobile armature 22 and are hitched thereto by means of pivot screws 36–37.

It will be noted that case 30 is held in position by the bottom lid 43 of case 2. This lid 43 also serves for holding the yoke 20 in grooves in case 2.

Figure 3:
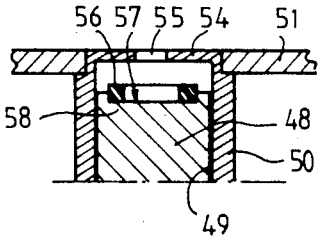
FIG. 3 shows schematically, in a sectional view, a part of the central socket which the core of the electromagnet comprises with a device for the pneumatic damping of the movement of the armature.

The bottom 54 of socket 50 (FIG. 3) is pierced with one or more holes 55 for allowing the air trapped between this bottom and core 48 to escape while playing the role of pneumatic damper; a resilient washer 56 placed coaxially with the core in a housing 57 formed at the end 58 thereof, completes the damping of the movement of the armature and thus avoids shocks which might otherwise cause the latch 5 and the rocking assembly 10 represented on FIG. 2 to separate, which are extremely sensitive.

Dividing walls such as 63 isolate the retractable contact levers from the electromagnet.

Tripping of the circuit breaker under the effect of a current overload or a short circuit is provided conventionally by the action of the current monitoring devices and consists in opening the mobile contact 12.

The retractable contact 11 pivots about a fixed pin 120 integral with case 2 and parallel to pin 24, when it is actuated by a movement of the armature 20 in response to the control signal applied to the terminals 32–33. This movement communicates to legs 34—35 a rectilinear movement contained in the plane II—II.

Since the cross piece 40 is guided between two surfaces parallel to the plane II—II, the movement of the grooves is itself a translational movement parallel to said plane, so that pin 24, which describes an arc of a circle, must move with respect to the bottom of the grooves perpendicularly to said plane.

A slight movement of legs 34–35 about their fixing pin to the armature compensates for a possible strict non parallelism between the plane of movement of the armature and the guide plane 42 guiding the face of the cross piece distant from the grooves. On the other hand, since the reaction of contact 15 when it pivots in an anticlockwise direction on opening is exerted in a direction tending to cause cross piece 40 to rock in a clockwise direction, it is at the level of the guide plane 41 of the other face of the cross piece that there is a risk of binding. The balls 61 overcome this risk.

It will be noted that the arrangement of the rake with respect to the electromagnet allows a particularly compact construction of the remote control assembly.

It goes without saying that different modifications may be made by a man skilled in the art to the embodiments described without departing from the scope and spirit of the invention.

What is claimed is:

1. A contact breaker for interrupting a power circuit, said contact breaker comprising:

i. an electrically insulating housing structure having first and second parallel guiding surface portions;

ii. a circuit breaker structure having first and second separable contacts;

iii. snap acting release means for causing automatic opening of the first contact in the occurence of overload current conditions in the power circuit;

iv. a pivoting lever supporting the second contact and having a pivoting axis and a coupling projection parallel to the pivoting axis, whereby when the coupling projection is subjected to a translational thrust substantially exerted in the plane of the first guiding surface, the lever will pivot about its axis to close and open the second contact;

v. a movable rake having a cross piece which forms first and second bearing surface portions respectively engaging the said first and second guiding surface portions, said cross piece further having a pushing member provided with an elongate groove which is substantially at right angles to said plane and intersects said plane, said coupling projection engaging said groove for receiving said thrust when the rake is displaced and said groove allows a translation of said coupling projection at right angles to said plane within said groove, said rake further having two legs which extend in the plane of said second guiding surface portion substantially parallel to said translational thrust and vi. electromagnetic actuating means comprising a movable armature which is hitched to said legs at the ends of said legs remote from the cross-piece and moves in a direction parallel to said plane for moving the rake when an electric control signal is applied to said actuating means, and means for hitching said legs to said armature while allowing oscillation of said legs about an axis parallel to said coupling projection.

2. A contact breaker as claimed in claim 1, wherein balls are interposed between said first bearing surface portion and said first guiding surface portion.

3. A contact breaker as claimed in claim 1, wherein said pushing member is fork shaped.

* * * * *